United States Patent [19]

Schuckmann et al.

[11] Patent Number: 4,962,851

[45] Date of Patent: Oct. 16, 1990

[54] DISPENSER

[75] Inventors: Alfred Von Schuckmann, Kevelaer, Fed. Rep. of Germany; James C. McKinney, Tega City, S.C.

[73] Assignee: Colgate-Palmolive Company, New York, N.Y.

[21] Appl. No.: 349,409

[22] Filed: May 8, 1989

[51] Int. Cl.[5] ..... B65D 37/00

[52] U.S. Cl. ..... 222/209; 222/387; 417/437; 417/472

[58] Field of Search ..... 222/207, 209, 212, 213, 222/215, 383, 386, 387, 256, 257, 259, 340, 341, 380, 391, 260; 417/437, 472; 92/104, 98 R

[56] References Cited

U.S. PATENT DOCUMENTS 2,632,475 3/1953 Elo ..... 92/104 X
2,774,518 12/1956 Greene ..... 417/437 X
3,870,200 3/1975 Spatz ..... 222/386 X
4,830,228 5/1989 Fillmore ..... 222/209

FOREIGN PATENT DOCUMENTS 8809483 12/1988 PCT Int'l Appl. ..... 222/212

*Primary Examiner*—H. Grant Skaggs
*Assistant Examiner*—David H. Bollinger
*Attorney, Agent, or Firm*—Nies, Kurz, Bergert & Tamburro

[57] ABSTRACT

A pump type dispenser having a bellows or diaphragm formed by a plurality of hollow ribs and valleys therebetween extending between a peripheral skirt and a central barrel. The valleys are inclined downwardly from the skirt to the barrel insuring the strength and resiliency of the diaphragm to return the diaphragm to its relaxed position after repeated activation.

16 Claims, 3 Drawing Sheets

DISPENSER

BACKGROUND OF THE INVENTION

This invention relates generally to a dispenser for fluent material such as toothpaste or the like, and more particularly to a pump-type dispenser having a pump bellows or diaphragm of novel construction.

Pump-type dispensers are generally known, and one such type dispenser is illustrated in co-pending U.S. patent application Ser. No. 07/195,249, filed May 18, 1988 by Alfred Von Schuckmann, a co-inventor of this invention. The novel bellows of this invention is considered to be an improvement over that illustrated in application Ser. No. 07/195,249. The remaining structure of the dispenser disclosed herein may be the same as that shown in Ser. No. 07/195,249.

In pump dispensers of this type, the pump bellows is subjected to flexing each time it is depressed to dispense the material from its storage compartment. The bellows must have sufficient strength and resiliency to return to its fully relaxed recovery position after repeated dispensing operations spaced over a substantial period of time, so that all the material contained with the dispenser can be used by the purchaser. In addition to being functionally reliable, the bellows must be shaped so as to simplify and expedite the manner and equipment by which it is manufactured.

SUMMARY OF THE INVENTION

Accordingly, a primary object of this invention is to provide a novel bellows for a pump-type dispenser, the bollows being simplified in construction and reliable in operation to withstand repeated successive activations over a substantial period of time.

Another object of the invention is to provide the novel bellows as above, the bellows having sufficient strength and resiliency to return to its fully relaxed recovery position even after repeated activation to discharge a uniform, predetermined amount of material with each activation and to enable the purchaser to use all the material within the container.

Still another object of the invention is to provide the above novel bellows which is of substantially uniform thickness throughout and includes a plurality of hollow ribs extending radially from a central discharge barrel to an outer peripheral skirt, the valleys between the ribs inclining downwardly from the outer peripheral skirt to the barrel.

A further object of the invention is to provide the above novel bellows wherein the ribs are formed with large radii where they join with the barrel to reduce stresses and avoid cracking as the bellows is flexed.

Another object of the invention is to provide the above novel bellows wherein in one embodiment the valleys between the ribs lie in a common substantially flat plane inclined downwardly from the outer peripheral skirt to the barrel.

A further object of the invention is to provide the above novel bellows wherein in another embodiment the valleys between the ribs incline downwardly from the peripheral skirt to the barrel and include concave dimples which maximize travel of the bellows and permit the plastic material of the bellows to spread as the bellows is depressed.

Still another object of the invention is to provide the above novel bellows formed integrally with the main tubular boby of the dispenser to facilitate production and assembly procedures.

Other objects and advantages of the invention will become apparent upon reading the following detailed description of the invention with reference to the accompanying drawings.

DETAILED DESCRIPTION OF THE INVENTION

Figure 1:
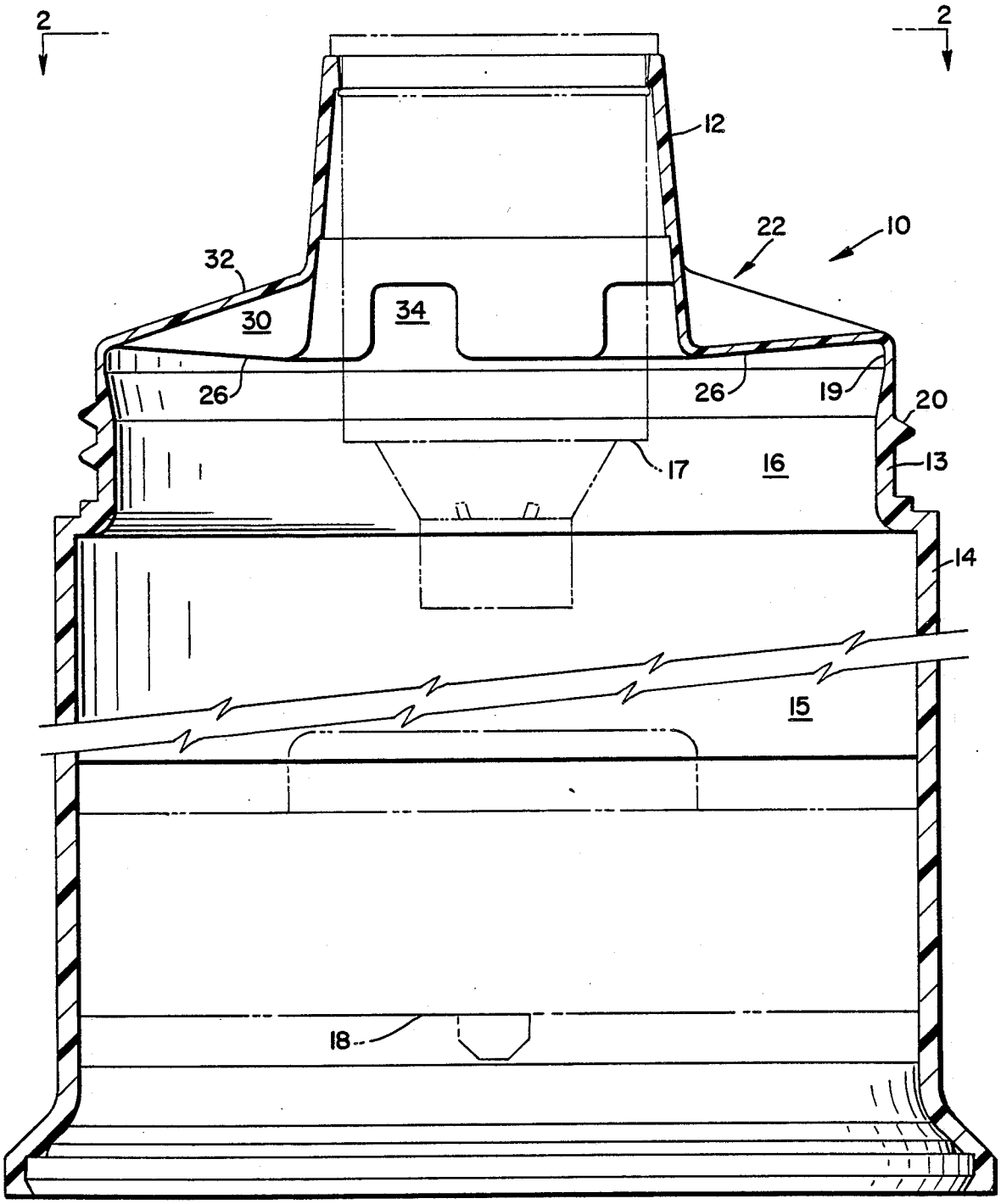
FIG. 1 is a fragmentary cross-sectional elevation view taken along line 1—1 of FIG. 2 and illustrating one embodiment of the novel bellows of the invention formed as an integral part of the cylindrical tubular body of a dispenser.
Figure 2:
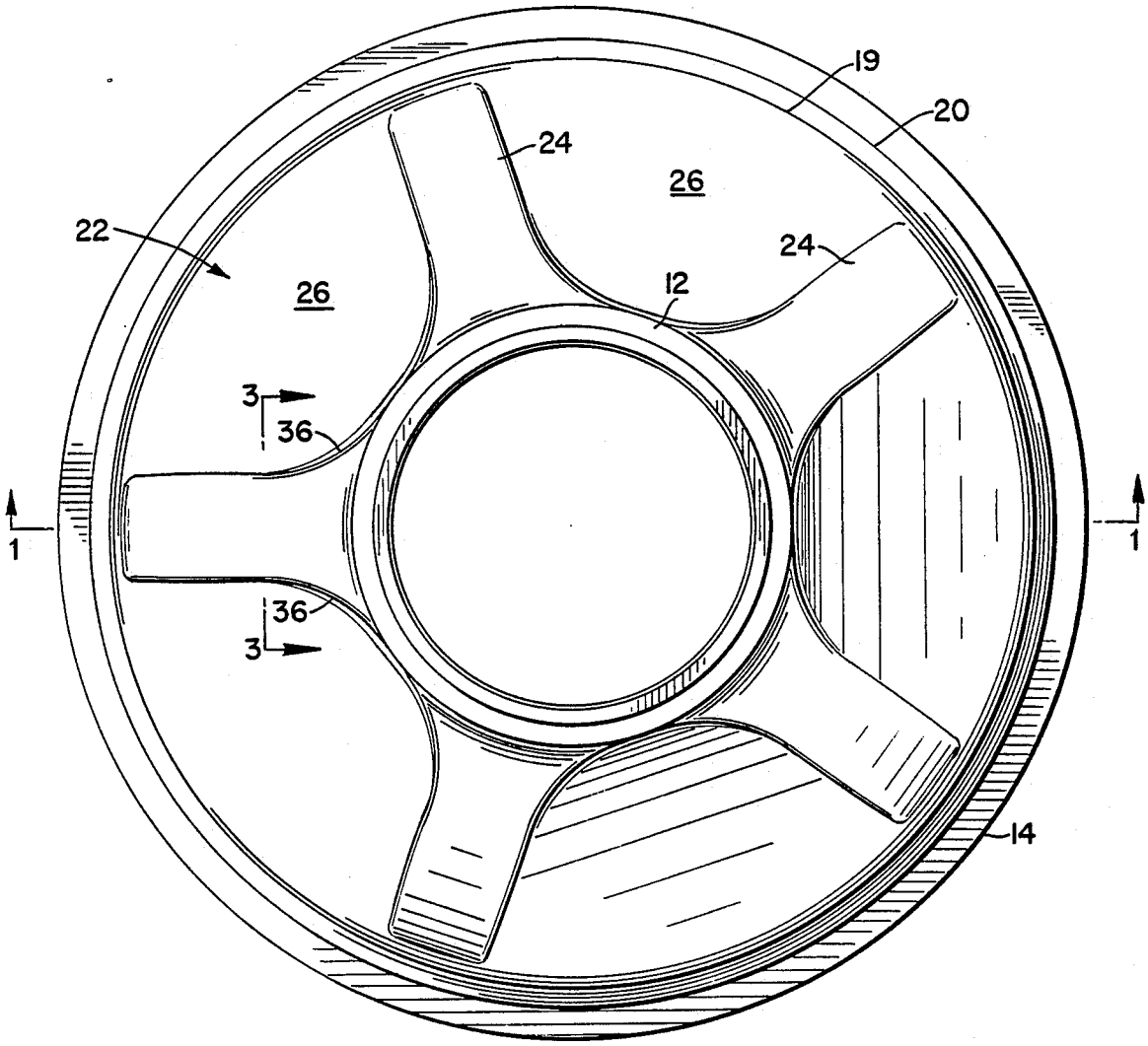
FIG. 2 is a top plan view taken along line 2—2 of FIG. 1.

A shown in FIGS. 1 and 2 wherein the elements are illustrated about four (4) times actual size, the novel bellows 10 of the invention is molded integrally with a central, cone-shaped barrel 12 and the cylindrical head section 13 of a main cylindrical tubular body 14 of a dispenser of the type shown in application Ser. No. 07/195,249. Bellows 10, barrel 12, head section 13, and body 14 are molded of flexible, non-stretchable plastic material, preferably polypropylene. As described in application Ser. No. 07/195,249, a primary toothpaste material is stored in compartment 15 within main body 14 and a secondary mouthwash paste material is stored on top of the toothpaste material within compartment 16 within head section 13. A striping insert 17 (shown in phantom) fits within barrel 12 and comminicates with compartments 15 and 16. Upon depression of bellows 10 and barrel 12 by a suitable actuator (not shown) pastes from compartments 15 and 16 are discharged through insert 17 to a suitable discharge spout (not shown) connected to barrel 12. Upon release of bellows 10, a partial vacuum is created to draw the material remaining in compartments 16 and 15 and a piston 18 (shown in phantom) therebelow upwardly to keep the space between the piston and barrel 12 filled with material and to prevent the formation of an air pocket.

Figure 3:
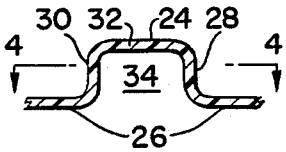
FIG. 3 is a fragmentary sectional view taken along line 3—3 of FIG. 2.
Figure 4:
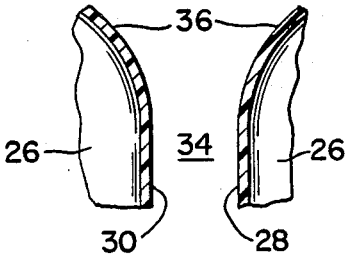
FIG. 4 is a fragmentary sectional view taken along line 4—4 of FIG. 3.

In the embodiment of FIGS. 1–4, bellows 10, includes an outer peripheral cylindrical skirt portion 19 integrally molded on cylindrical head section 13 which is formed with external threads 20 to receive a cap (not shown). A web or membrane section 22 is formed by a plurality of equiangularly spaced hollow ribs 24 and essentially trapezoidal shaped valleys 26 therebetween extending radially between skirt 19 and barrel 12. Ribs 24 include a pair of side walls 28 and 30 extending vertically from valleys 26 and a top wall 32 inclined upwardly at an angle of about 18° from skirt 19 to barrel 12, with side walls 28 and 30 and top wall 32 defining a hollow chamber 34 which is substantially rectangular in cross section and open at the bottom as shown in FIG. 3. Walls 28 and 30 are provided with a large radius section 36 by which they join with barrel 12 to reduce stresses and enhance flexibility in this area. Section 36 has a radius larger than the spacing between walls 28 and 30, e.g. the radius is about one and one-half ($1\frac{1}{2}$) times the width of chamber 34.

As shown best in FIG. 1, each valley 26 inclines downwardly at an angle of about 5° from skirt 19 to barrel 12, and all the valleys 26 lie in the same substantially flat uniform plane.

Skirt 19, ribs 22, and valleys 26 are of substantially uniform wall thickness throughout (about 0.020 inches). This feature, together with the fact that all the ribs 24 are identical and the valleys 26 are the same, facilitates production techniques and provides uniform, predictable, and dependable deflection of the bellows to produce repeated dispensing operations of metered amounts of paste material. Upon axial depression of barrel 12 and bellows 10 by an actuator, walls 28 and 30 of ribs 24 diverge from each other and chamber 34 is spread open, with each rib thus becoming a reservoir of resilient spring force that snaps the bellows and barrel back to their normal rest position upon release of the actuator. The large radii sections 36 reduce concentrated stresses and prevent premature cracking and failure of the material in this area due to fatigue.

Figure 5:
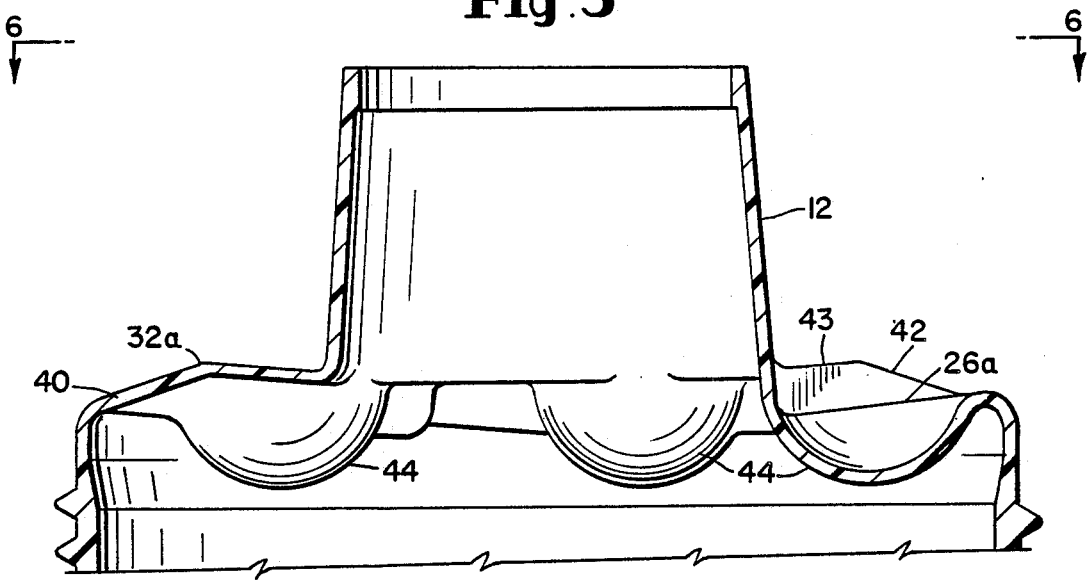
FIG. 5 is a view similar to FIG. 1, but illustrating another embodiement of the invention.
Figure 6:
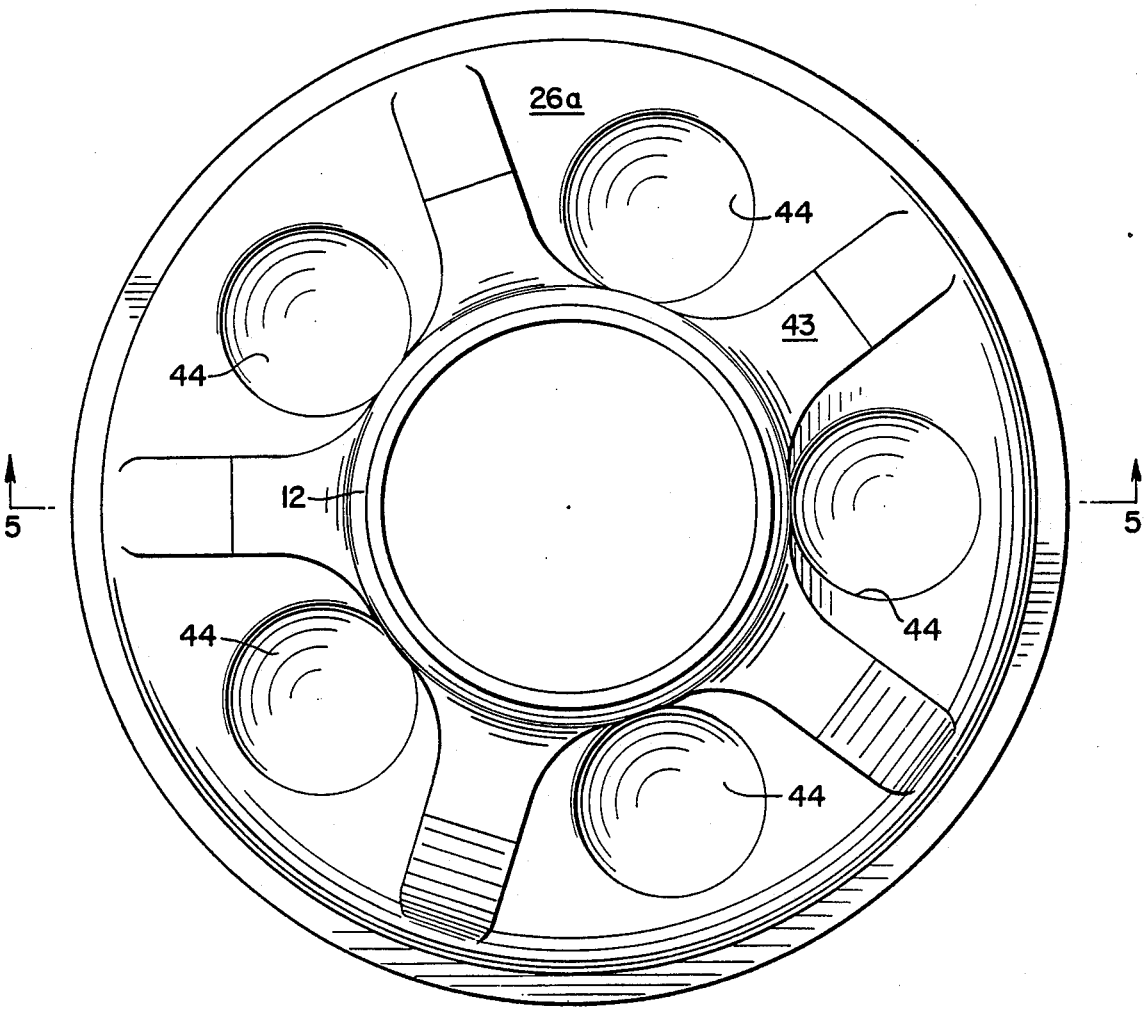
FIG. 6 is a top plan view taken along line 6—6 of FIG. 5.

The embodiment of bellows 10*a* shown in FIGS. 5 and 6 differs somewhat from that of bellows 10 in FIGS. 1 and 2. Top wall 32*a* of the hollow ribs includes and outer portion 40 which inclines upwardly from skirt 19 to a point 42 where an inner portion 43 reverses and inclines downwardly toward barrel 12 to give more travel to the bellows and barrel when they are depressed. In addition, each of the dwell areas 26*a*is provided with a spherical dimple 44 of substantial size and depth to form a concave depression therein. The dimples maximize the amount of travel and deflection of the bellows and permit the plastic material of the bellows to spread during deflection.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A dispenser for dispensing material comprising tubular means for housing said material, discharge means at one end of said housing, piston means mounted within said tubular means and being incrementally displaceable towards said one end, pump diaphragm means comprising peripheral skirt means connected to said tubular means, central discharge barrel means connected with said discharge means, and a plurality of angularly spaced, raised hollow ribs and valleys therebetween extending radially between said skirt means and said barrel means, all of said valleys inclining downwardly from said skirt means to said barrel means, said diaphragm means being displaceable from a rest position towards said piston means to cause discharge of material from said tubular means through said discharge means.

2. The dispenser according to claim 1, each of said ribs including spaced side walls and a top wall defining a hollow chamber, each of said walls being formed with a large radius joining said barrel means, said radius being larger than the spacing between said side walls.

3. The dispenser according to claim 2, wherein said chamber is substantially rectangular in cross section and open at the bottom.

4. The dispenser according to claim 1, wherein said tubular means and said diaphragm means are of plastic material and are integrally molded together.

5. The dispenser according to claim 4, sair tubular means including a cylindrical head section having external threads formed thereon, said diaphragm means being integrally molded on said head section.

6. The dispenser according to claim 1, wherein said ribs incline upwardly from said skirt means to said barrel means and said valleys lie in substantially the same plane.

7. A pump diaphragm for use in a dispenser comprising peripheral skirt means, central discharge barrel means, a plurality of angularly spaced, raised hollow ribs and valleys therebetween extending radially between said skirt means and said barrel means, all of said valleys inclining downwardly from said skirt means to said barrel means.

8. The diaphragm according to claim 7, said ribs including spaced side walls and a top wall defining a hollow chamber, each of said side walls being formed with a large radius joining said barrel means, said radius being larger than the spacing between said side walls.

9. The diaphragm according to claim 8, wherein said chamber is substantially rectangular in cross section and open at the bottom.

10. The diaghragm according to claim 7, wherein said ribs incline upwardly from said skirt means to said barrel means and said valleys lie in substantially the same plane.

11. A dispenser for dispensing material comprising tubular means for housing said material, discharge means at one end of said housing, piston means mounted within said tubular means and being incrementally displaceable towards said one end, pump diaphragm means comprising peripheral skirt means connected to said tubular means, central discharge barrel means connected with said discharge means, and a plurality of angularly spaced, raised hollow ribs and valleys therebetween extending radially between said skirt means and said barrel means, said valleys inclining downwardly from said skirt means to said barrel means, each of said valleys being provided with a concave depression to enhance travel and deflection, said diaphragm means being displaceable from a rest position towards said piston means to cause discharge of material from said tubular means through said discharge means.

12. The dispenser according to claim 11, wherein said concave depression is substantially spherical.

13. The dispenser according to claim 12, wherein said ribs have an inner portion which inclines downwardly to said barrel means.

14. A pump diaphragm for use in a dispenser comprising peripheral skirt means, central discharge barrel means, a plurality of angularly spaced, raised hollow ribs and valleys therebetween extending radially between said skirt means and said barrel means, said valleys inclining downwardly from said skirt means to said barrel means, each of said valleys being provided with a concave depression to enhance travel and deflection.

15. The diaphragm according to claim 14, wherein said concave depression is substantially spherical.

16. The diaphragm according to claim 15, wherein said ribs have an inner portion which inclines downwardly to said barrel means.

* * * * *